US009800359B2

(12) United States Patent
Turner

(10) Patent No.: US 9,800,359 B2
(45) Date of Patent: Oct. 24, 2017

(54) RADIO COMMUNICATION DEVICES AND METHODS THEREOF

(71) Applicant: Interconnect Media Network Systems, Selma, VA (US)

(72) Inventor: Steven Turner, Selma, VA (US)

( * ) Notice: Subject to any disclaimer, the term of this patent is extended or adjusted under 35 U.S.C. 154(b) by 0 days.

(21) Appl. No.: 13/936,892

(22) Filed: Jul. 8, 2013

(65) Prior Publication Data

US 2015/0011156 A1 Jan. 8, 2015

(51) Int. Cl.

| | |
|---|---|
| ***H04H 60/27*** | (2008.01) |
| *H04H 60/47* | (2008.01) |
| *H04H 60/48* | (2008.01) |
| *H04H 60/51* | (2008.01) |

(52) U.S. Cl.

CPC ..... *H04H 60/27* (2013.01); *H04H 60/47* (2013.01); *H04H 60/48* (2013.01); *H04H 60/51* (2013.01)

(58) Field of Classification Search

USPC ..... 375/219, 220

See application file for complete search history.

(56) References Cited

U.S. PATENT DOCUMENTS

| | | | | |
|---|---|---|---|---|
| 2003/0228855 | A1* | 12/2003 | Herz et al. | 455/185.1 |
| 2005/0044561 | A1 | 2/2005 | McDonald | |
| 2008/0256080 | A1* | 10/2008 | Irvin et al. | 707/10 |
| 2009/0247096 | A1 | 10/2009 | Walley et al. | |
| 2009/0281897 | A1 | 11/2009 | Antos | |
| 2013/0053058 | A1* | 2/2013 | Li | H04H 20/26 455/456.1 |
| 2013/0300536 | A1* | 11/2013 | Bell | 340/7.45 |

OTHER PUBLICATIONS

International Search Report for International Patent Application No. PCT/US/14/45764 (Mar. 11, 2015).

* cited by examiner

*Primary Examiner* — Kabir A Timory
(74) *Attorney, Agent, or Firm* — LeClairRyan, a Professioal Corporation

(57) ABSTRACT

A method, non-transitory computer readable medium, and apparatus for identifying content from one or more radio frequency signals. One or more radio frequency signals are monitored for available content. The one or more radio frequency signals with available content are processed to obtain audio or data associated with the one or more radio frequency signals. The obtained audio or data is analyzed. The radio frequency signals are categorized based on the analyzed audio or data. One or more items of information related to the radio frequency signals are identified. The one or more items of categorizing information are stored.

26 Claims, 3 Drawing Sheets

RADIO COMMUNICATION DEVICES AND METHODS THEREOF

FIELD

The present invention relates generally to a radio communication device, and more particularly to an enhanced radio communication device that provides for increased functionality and processing of received radio frequency signals.

BACKGROUND

Standard radio communication devices are limited in functionality as compared to devices that receive and process signals transmitted through wired technologies, such as analog and digital cable, digital subscriber lines and fiber optic lines. These signals are received by modems or converters, and the processed signals are then communicated to routers, televisions, digital video recorders and computers for display and manipulation of the audio and video content.

More detailed and complex information can be provided with these wired broadcast signals, and devices, such as digital video recorders and computers. Further, devices such as digital video recorders and computers provide for the recording of received information from the wired broadcast signals. In addition, the data processing capability of computers and networks are available to process the received information. For example, crawler programs are available to search for information in networks such as the Internet or World Wide Web. These functionalities are only available for content delivered through these types of networks and are not available for information broadcast through transmitted radio signals. In addition, these systems often employ multiple components for the receipt, processing, recording, and display of the transmitted content.

Standard radio communication devices, such as radio receivers, receive radio signals and process those signals into a format that provides audio and limited data output to a user of the radio receiver. For example, in addition to programming content, such as songs or speech, standard radio devices may receive radio broadcasts that also include identifying information or data, e.g., station identification and song or artist information, which is transmitted in the same signal. Standard radio receivers are, however, limited to outputting the audio content and displaying the additional identifying information broadcast by a radio station and are not capable of processing and displaying more detailed or complex information. Standard radio receivers are also limited in their ability to record content from broadcast signals that are received and processed by the radio receivers. Although standard radio receivers can be associated with recording devices, for example tape decks, such recording devices are typically separate from the radio receivers and are in communication with the radio receiver through a larger collection of audio connectors and components.

SUMMARY

A radio communication device includes a transceiver configured to receive one or more radio frequency signals and a radio computing device coupled to the transceiver. The radio computing device includes a memory coupled to a processor configured to execute programmed instructions stored in the memory including monitoring one or more received radio frequency signals for available content. The one or more radio frequency signals with available content are processed to obtain at least one of audio or data associated with the one or more radio frequency signals. The obtained audio or data is analyzed and the radio frequency signals are categorized based on the analyzed audio or data. One or more items of information related to the radio frequency signals are identified. The one or more items of categorizing information are stored on the radio communication device.

A method includes receiving, by a radio device, one or more radio frequency signals. The one or more received radio frequency signals are monitored for available content. The one or more radio frequency signals with available content are processed to obtain audio or data associated with the one or more radio frequency signals. The obtained audio or data is analyzed. The radio frequency signals are categorized based on the analyzed audio or data. One or more items of information related to the radio frequency signals are identified. The one or more items of categorizing information are stored.

A non-transitory computer readable medium having stored thereon instructions for identifying content from one or more radio frequency signals comprising machine executable code which, when executed by a processor, causes the processor to perform step including monitoring one or more radio frequency signals for available content. The one or more radio frequency signals with available content are processed to obtain audio or data associated with the one or more radio frequency signals. The obtained audio or data is analyzed. The radio frequency signals are categorized based on the analyzed audio or data. One or more items of information related to the radio frequency signals are identified. The one or more items of categorizing information are stored.

This technology provides a number of advantages including providing more effective devices and methods for identifying content from one or more radio frequency signals. With this technology, a radio communication device receives and processes content from radio broadcast signals. The content is monitored, analyzed, categorized, and stored. The technology provides additional functionality for radio communication devices including searching and recording for specific desired content. The technology also provides the ability to identify and alert users about information related to emergencies, such as natural disasters, based on information broadcast over radio signals to interested parties. The technology also facilitates communication among members of a defined group of users.

DETAILED DESCRIPTION

Figure 1:
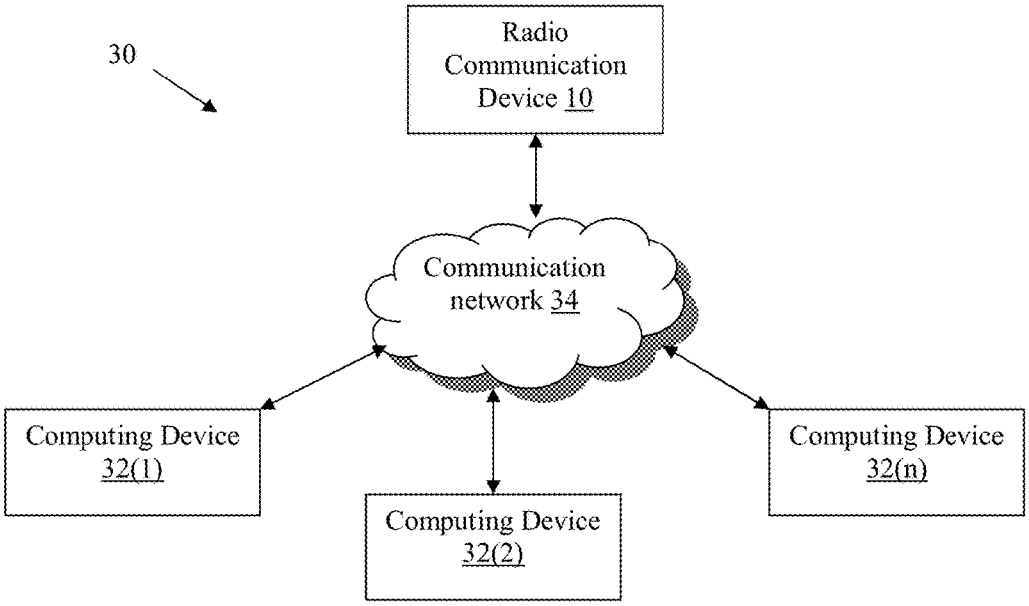
FIG. 1 is an exemplary environment with a radio communication device of coupled to a plurality of computing devices via a communication network.
Figure 2:
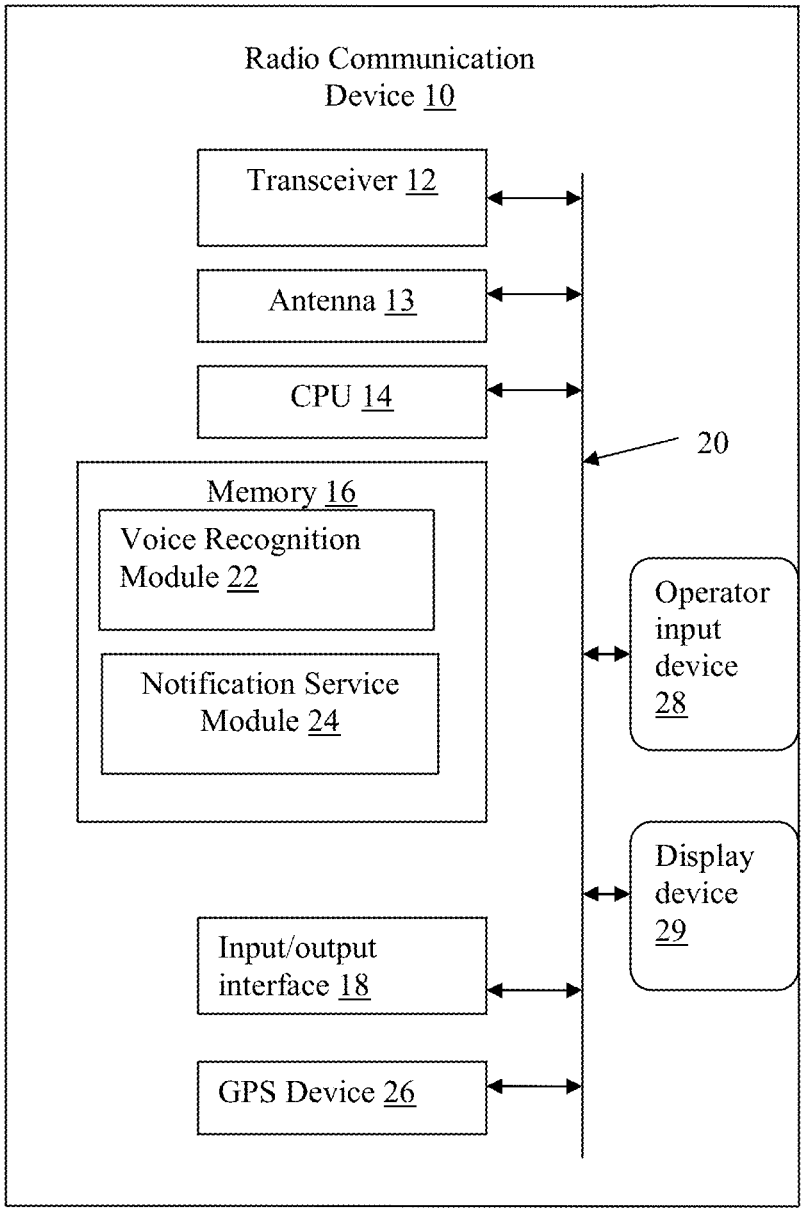
FIG. 2 is an exemplary embodiment of a radio communication device.

An exemplary environment 30 with a radio communication device 10 is illustrated in FIGS. 1-2. The environment 30 includes the radio communication device 10 and a plurality of computing devices **32(1)-32(*n*) coupled via a communication network 34**, although this environment can include other numbers and types of systems, devices, components, and elements connected together in other configurations with other types and numbers of communication networks. This technology provides a number of advantages including providing more effective methods and devices for identifying content from one or more radio frequency signals to allow for further functionality for a user with respect to the identified content.

Referring more specifically to FIGS. 1-2, the radio communication device 10 is adapted to identify content from one or more radio frequency signals. Although an example of this technology is described in relation to radio communication device 10, it is to be understood that this technology may be incorporated in any suitable computing device, such as a laptop computer, desktop computer, smart television, mp3 player, video game system, tablet computing device, PDA, server, or any other computing device. The radio communication device 10 may include a stand-alone unit cased in its own housing, or alternatively may be a housed in another device, for example, a car stereo.

The radio communication device 10 includes a transceiver 12 coupled to an antenna 13, a central processing unit (CPU) or processor 14, a memory 16, an input/output interface 18, operator input device 28, and display device 29 which are coupled together by a bus 20 or other link, although the radio communication device 10 could have other types and numbers of systems, devices, component, and additional elements in other configurations.

The transceiver 12 is configured to receive and process radio frequency signals received through the coupled antenna 13, although the transceiver may receive and process other types of signals from other sources. Although this technology is described with respect to transceiver 12, it is to be understood that other devices could be utilized to receive and process radio frequency signals, such as a receiver or a transmitter/receiver each with their own circuitry. In one embodiment, transceiver 12 is configured to receive and to process a plurality of radio frequency signals from a plurality of simultaneous radio frequency signal transmissions.

The transceiver 12 is configured to receive radio frequency signals that are electromagnetic broadcast frequencies including both analog and digital signals transmitted using either amplitude modulation or frequency modulation, although this technology also could be utilized with other types of signals, such as satellite based radio communications by way of example only. Although this technology is described with respect to radio frequency signals, such as signals with a rate of oscillation in the range of 30 MHz to 300 MHz, it is to be understood that this technology may be utilized with signals of different frequencies that are delivered over different transmission mechanisms, such as aviation voice radios, which use very high frequency (VHF) amplitude modulated (AM) signals and marine voice radios that use single sideband voice (SSB) in the shortwave High Frequency (HF) radio spectrum of from about 3 MHz to about 30 MHz. This technology also is compatible with government, police, fire and commercial voice services which use narrowband frequency modulated (FM) signals on special frequencies. Another suitable signal for use with this technology is Terrestrial Trunked Radio (TETRA), which is a digital cell phone system for military, police and ambulances.

Other examples of suitable frequencies and wavelengths include low frequency (LF) from about 30 kHz to about 300 kHz with a wavelength of about 1 to 10 km, medium frequency (MF) of from about 300 kHz to about 3000 kHz at a wavelength of from about 100 to 1000 m AM and high frequency (HF) of from about 3 MHz to about 30 MHz and very high frequency (VHF) of about 30 MHz to about 300 MHz at a wavelength of from about 1 to 10 m FM, which are used in radio broadcasts, television broadcasts, private mobile radio (PMR), Digital Video Broadcasting-Terrestrial (DVB-T) and MRI. This technology also may by way of example be used with ultra high frequency (UHF) signals of from about 300 MHz to about 3000 MHz with wavelengths of about 10 to 100 cm. This technology also may be compatible for using and monitoring signals from PMR, television broadcast, GPS, mobile phone communication (GSM, UMTS, 3G, HSDPA), (DECT), WLAN (Wi-Fi 802.11 b/g/n), Bluetooth. SHF 3 to 30 GHz 1 to 10 cm DBS satellite television broadcasting, WLAN (Wi-Fi 802.11 a/n), microwave relays and WiMAX, radars. This technology also may be used with longwave AM radio at about 148.5-283.5 kHz (LF), mediumwave AM radio at about 530 kHz-1710 kHz (MF) and shortwave AM radio at about 3 MHz-30 MHz (HF), although use with other frequency signals may be contemplated.

The transceiver 12 is configured to process the received radio frequency signals to provide broadcast content and any auxiliary data from the radio frequency signals to the processor 14. By way of example only, the broadcast content may include songs or speech broadcast by a radio station, although the broadcast content may be other types of information transmitted by a radio frequency signals, such as emergency information transmitted over an emergency radio broadcast frequency signal. By way of example only, the auxiliary data may include song title information, radio station identification, metadata, or other electronic files, although the auxiliary data may include other types of data capable of being transmitted by radio frequency signals. Transceiver 12 is in communication with the processor 14 through bus 20, although in other embodiments the transceiver 12 may be integrated directly with the processor 14.

The antenna 13 is any suitable antenna for receiving radio frequency signals delivered through air, although other manners for obtaining the signal to process could be used, such as through a hard wired connection from another source. Although antenna 13 is illustrated as an internal antenna, antennae in other configurations, such as an external antenna may be utilized.

The processor 14 in the radio communication device 10 is configured to execute a program of stored instructions for one or more aspects of the present technology as described and illustrated by way of examples herein, although other types and numbers of processing devices and logic could be used and the processor 14 could execute other numbers and types of programmed instructions. In this particular example, the processor 14 also is configured to execute stored programmed instructions to control all operations and other functions of the radio communication device 10. Additionally, in this particular example the processor 14 is configured to download and record to memory 16 broadcast and auxiliary data received by antenna 13 and processed by the transceiver 12. By way of example, the processor may be programmed with instructions to record signals from a specific radio frequency at a specific time for a specific period of time input by the user, although the data may be recorded in other manners, such as a direct input by the user to perform the record function.

The memory 16 in the radio communication device 10 stores the programmed instructions and/or other data for one or more aspects of the present technology as described and illustrated herein, although some or all of the programmed instructions could be stored and executed elsewhere. A variety of different types of memory storage devices, such as random access memory (RAM) or a read only memory (ROM) in the system or a floppy disk, hard disk, CD ROM, DVD ROM, tape drives, jump drives, flash drives, secure digital (SD) cards, or other computer readable medium which is read from and written to by a magnetic, optical, or other reading and writing system that is coupled to the processor 14, can be used for the memory 16. The memory 16 in the radio communication device 10 may store programmed instructions for performing one or more aspects of the present technology described and illustrated in more detail below. By way of example only, the memory 16 can store programmed instructions for a voice recognition module 22 and a notification service module 24, although the memory may store other types and amounts of modules and other programmed instructions and/or other data.

The voice recognition module 22 stored in the memory 16 of the radio communication device 10 comprises programmed instructions to analyze the broadcast content delivered through the radio frequency signals for keywords, although the voice recognition module may have programmed instructions to provide other types of operations or functions, such as analyzing spoken commands from the user. The notification service module 24 stored in the memory 16 of the radio communication device 10 provides alerts regarding the detection of certain events based on the received broadcast content and auxiliary data.

The input/output interface 18 in the radio communication device may be used to operatively establish a connection and communicate between the radio communication device 10 and other electronic devices over one or more wired or wireless communication networks. By way of example only, the input/output interface 18 can be a wireless communication device such as a Bluetooth device, although other types and numbers of communication networks or systems with other types and numbers of connections and configurations can be used. In this example, the input/output interface 18 of the radio communication device 10 operatively couples and facilitates communication between the radio communication device 10 and the computing devices 32(1)-32(*n*) via the communications network 34, although other types and numbers of communication networks or systems with other types and numbers of connections and configurations can be used. By way of example only, the communications network could use TCP/IP over Ethernet and industry-standard protocols, including NFS, CIFS, SOAP, XML, LDAP, and/or SNMP, although other types and numbers of communication networks, such as a direct connection, a local area network, a wide area network, each having their own communications protocols, can be used.

In this particular example, the radio communication device 10 includes an optional GPS device 26 capable of monitoring the location of the radio communication device 10. The GPS device may be utilized to obtain geographic information with respect to a received radio frequency signal, although the GPS may be utilized for other purposes.

In this example, the operator input device 28 and the display device 29 are both part of the radio communication device 10, although other configurations can be used, such as having one or both of the operator input device 28 and/or the display device 29 coupled to, but separate and outside of the radio communication device 10. Additionally, in other examples the operator input device 28 and the display device 29 could comprise the same device, such as a touchscreen interactive display device. By way of example only, operator input device 28 may include a keyboard, microphone, a tuning mechanism, such as a potentiometer, an earphone port or headphone jack, a speaker, switches, expansion ports, parallel ports, serial ports such as a USB port, or a point and click mechanism, such as a computer mouse. The operator input device 28 may control one or more of the functions of the radio communication device 10 including, by way of example, controlling the output of audio content, such as play, pause, stop, fast forward, rewind, skip and back. The operator input device 28 may further interact with and provide programmed instructions to the processor 14 of the radio communication device 10 in order to, by way of example only, record content, identify content which should be monitored for by the radio communication device 10, or to search for desired content, although the operator input device 28 may provide for additional programming of the processor 14 and/or provide other instructions and/or data.

The display device 29 may include an LED display device, an LCD device or a CRT display device and/or other visual and/or audio display devices, such as speakers or speakers with a display, although other types and numbers of operator input devices and/or display devices can be used. The display device 29 also may provide the audio and/or data content to the user, by way of example only, through speakers, a headphone jack, or a display interface. The display device 29 also may provide the user with displayed and/or audio alerts.

The computing devices 32(1)-32(*n*) may include an onboard vehicle computer, digital music players, digital video players, digital text devices, GPS devices, cameras, computers, PDAs and cellular phones, although computing devices 32(1)-32(*n*) may be any suitable computing devices capable of communicating with the radio communication device 10 via communication network 34. Each of the computing devices 32(1)-32(*n*) may include a central processing unit (CPU), a memory, and input/output interface which are coupled together by a bus or other link, although each may have other types and numbers of systems, devices, components, and elements in other configurations.

The computing devices 32(1)-32(*n*) may be registered with the notification service 24 of the radio communication device 10 to receive alerts regarding the detection of certain events based on the received broadcast content and auxiliary data.

Although examples of the radio communication device 10 are described herein, the radio communication device can be implemented on any suitable computer system or computing device. It is to be understood that the devices and systems of the examples described herein are examples, as many variations of the specific hardware and software used to implement the examples are possible, as will be appreciated by those skilled in the relevant art(s).

The disclosed technology also may be embodied as a non-transitory computer readable medium having instructions stored thereon for one or more aspects of the present technology as described and illustrated by way of the examples herein, which when executed by a processor, cause the processor to carry out the steps necessary to implement the methods of the examples, as described and illustrated herein.

Figure 3:
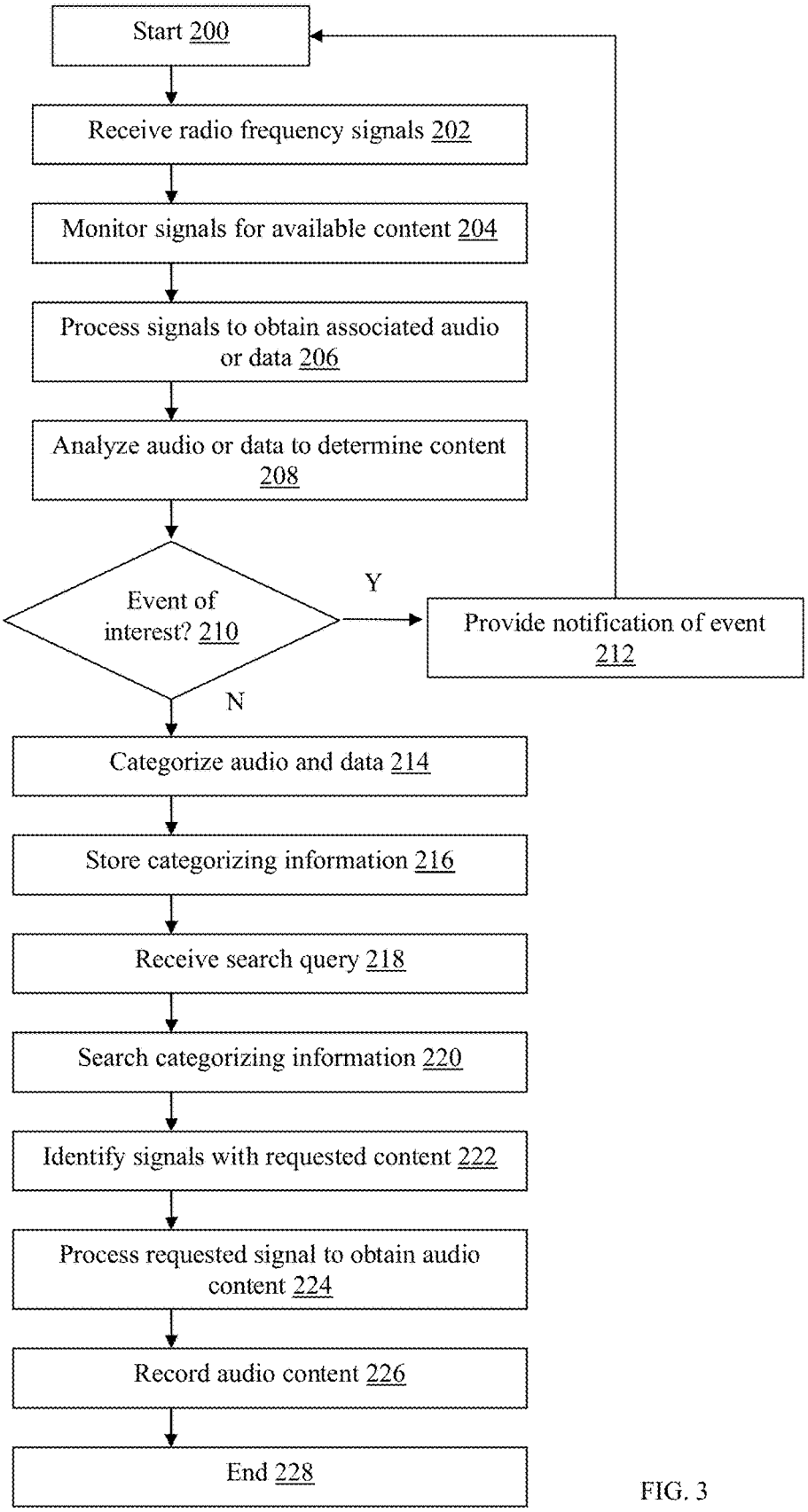
FIG. 3 is a flow chart of a method for identifying content from one or more radio frequency signals.

A method for indentifying content from one or more radio frequency signals will now be described with reference to FIGS. 1-3. At step 200, the method for identifying content from one or more radio frequency signals is initiated at the radio communication device 10.

At step 202, the radio communication device 10 receives one or more radio frequency signals. The one or more radio frequency signals may be any radio frequency signals within range of the transceiver 12 of the radio communication device 10. The radio communication device 10 may receive a plurality of radio frequency signals simultaneously.

At step 204, the radio communication device 10 monitors the received radio frequency signals for available content. By way of example only, the radio communication device 10 scans received radio frequency signals within the range of the radio communication device 10. A broad range of frequencies are monitored, and as content is discovered at a given frequency, the radio communication device 10 searches the received radio frequency broadcast signals for broadcast content and auxiliary data.

At step 206, the one or more radio frequency signals are processed by the radio communication device 10 to obtain the audio or data associated with the radio frequency signal. In this example, the radio frequency signals are processed by the radio communication device 10 to obtain broadcast content in the form of speech or audio, although other broadcast content may be processed and/or obtained in other manners. Additional auxiliary data that can be captured or otherwise obtained by the radio communication device 10 includes, by way of example only, electronic files, computer data, geographic location data, radio station identification data, metadata, internet protocol (IP) addresses, date, time, advertising information, coupons, and artist and song data.

At step 208, the obtained audio and data is analyzed by the radio communication device 10 to determine the content of the broadcast frequency signal. The radio communication device 10 analyzes the obtained audio signal using, for example, voice recognition module 22. For example, the audio is analyzed to identify whether the audio comprises music or speech. If the audio from the radio frequency signal contains speech, the speech is analyzed for keywords that indicate the content of the speech, by way of example, politics or sports. This content can include specific content information, for example, presidential politics or a particular sports team. The analysis also may involve analyzing any available auxiliary data that was obtained, by way of example. The auxiliary data may, by way of example, include a song title, radio station identifier, or other metadata that can be used to analyze the broadcast content.

In this example, the audio and data content are analyzed by the radio communication device 10 for information indicating or relating to a specific event, such as an emergency situation, by way of example, a natural or man-made disaster, while the content may be analyzed for the occurrence of other events such as the broadcasting of a particular song or sporting event identified as being of interest to a user of the radio communication device 10. The broadcast frequencies are located within a user-defined geographical area of interest or a subject matter area of interest, e.g., floods, hurricanes or tornadoes. The geographical area of interest can be the area in which the user is currently located which may be identified by the GPS device 26, or a particular area of interest selected by the user.

At step 210, the radio communication device 10 determines whether a particular event of interest has occurred based on the analysis performed at step 208. If in step 210, the particular event is determined to have occurred, then the Yes branch is taken to step 212.

In step 212, the notification of the occurrence of the event is provided to the user by the radio communication device 10 via the display device 29 and then returns back to step 200 as described earlier. The notification may be provided as an audio alert and/or a visual message, although other types of alerts may be contemplated. The radio communication device 10 also may provide notification of the occurrence of the event to computing devices 32(1)-32(*n*) registered to the notification service 24 of the radio communication device 10. The notice is provided to the computing devices 32(1)-32(*n*) via the communication network 34 by the radio communication device 10, although the notice could be provided by a radio frequency signal from transceiver 12.

If back in step 210, a particular event is not determined to have occurred, then the No branch is taken to step 214. In step 214, the radio frequency signals are categorized by the radio communication device 10 based on the analysis of the obtained audio and data. The obtained audio and data is categorized in association with an identification of the radio frequency and any other identifying information or data obtained for that radio frequency signal. The radio frequency signals also may be characterized based on one or more items of information related to the radio frequency signal based on the obtained audio and auxiliary data. By way of example, the radio frequency signals may be categorized based on geographic location, station content, metadata, radio station call letters, content rating, keywords, owner information, internet protocol (IP) address, genre, and any other publically available information broadcast by the radio frequency signal.

At step 216, the categorizing information is stored in the memory 16 of the radio communication device 10, although the categorizing information may be stored in other locations on other devices. The stored information is then available for other users of the system to locate radio signals having a desired type of content falling within a particular category. The categorization data is stored, either with or without the analyzed data, but with an association to the audio or data sources that yielded the categorized data.

At step 218, a search query is received by the radio communication device 10. The stored categorization data can be searched by a user using the operator input device 28 and the display device 29 of the radio communication device 10, although a user could search the categorization data from one of the external computing devices 32(1)-32(*n*) via the communication network 34. The user may search for particular items of content such as, by way of example only, a particular song, a genre of music, a category of content such as sports or politics, although the user may search for other items of content based on other items of categorizing information, such as geographic location.

At step 220 the radio communication device 10 searches the stored one or more items of categorizing information in response to the user's search query. At step 222, the radio communication device 10 identifies one or more radio frequency signals comprising the requested one or more items of content in response to the search query. The radio communication device 10 displays on display device 29 the identified radio frequency signals for selection by the user using the operator input device 28. The radio communication device 10 provides the user with a list of sources of data that fit within the desired category of information. By way of example only, the user may be provided with a list of all radio stations on the display device 29 broadcasting a specific content for which the user has searched. The categorization can be provided in real time so that the user can switch to a live broadcast of the desired content. Alternatively, the categorization of the radio frequency signals may include a temporal element that identifies when the requested category of content is available from a given source.

At step 224, the identified radio frequency signal containing the content requested by the user through the search query is obtained by antenna 13 and processed by the transceiver 12 in the radio communication device 10 to obtain the associated audio content, although other manners for obtaining the signal can be used.

At step 226, the obtained audio content is recorded by the radio communication device 10 and stored in the memory 16, although the recorded content may be stored in other locations on other devices. Auxiliary data transmitted along with the broadcast content can also be saved for future access. By way of example, a radio station could send coupons or event tickets electronically through the radio frequency broadcast. In one embodiment, the radio communication device 10 is programmed to record the specified station, i.e., a specified broadcast radio frequency, at a predetermined time for a predetermined length of time. Alternatively, broadcasted radio content may be recorded when a user activates the record function through one of the input/output devices 28, such as push button, touch screen or voice command. Next, the method can return to step 200 or as in this example can end at step 228.

Accordingly, as illustrated and described with reference to the examples herein, this technology provides a number of advantages including providing more effective devices and methods for identifying content from one or more radio frequency signals. With this technology, a radio communication device receives and processes content from radio broadcast signals. The content is monitored, analyzed, categorized, and stored. The technology provides additional functionality for radio communication devices including searching and recording for specific desired content. The technology also provides the ability to identify and alert users with information related to emergencies, such as natural disasters, based on information broadcast over radio signals to interested parties.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Accordingly, the invention is limited only by the following claims and equivalents thereto.

What is claimed is:

1. A radio communication device comprising:

a transceiver configured to receive one or more radio frequency signals;

a radio computing device coupled to the transceiver, wherein the radio computing device comprises a memory coupled to a processor configured to execute programmed instructions stored in the memory comprising:

simultaneously receiving a plurality of air broadcast radio frequency signals within range of the transceiver and identifying a subset of the plurality of air broadcast radio frequency signals having available content;

processing one or more of the subset of the plurality of air broadcast radio frequency signals to obtain audio and auxiliary data associated with the one or more of the subset of the plurality of air broadcast radio frequency signals;

analyzing the obtained audio and auxiliary data from the processed one or more of the subset of the plurality of air broadcast radio frequency signals to identify one or more items of content indicating the occurrence of an event;

categorizing the one or more of the subset of the plurality of air broadcast radio frequency signals based on the analyzed audio and auxiliary data, wherein the categorizing further comprises identifying one or more items of categorizing information related to the event; and storing the one or more items of categorizing information along with the analyzed audio and auxiliary data.

2. The radio communication device of claim 1 wherein analyzing the obtained audio further comprises performing a voice recognition analysis of the obtained audio.

3. The radio communication device of claim 1 wherein the identified one or more items of information related to the categorized radio frequency signals comprise a category of content, a source of the radio frequency signal, and a temporal identification of when the content is available.

4. The radio communication device of claim 1 wherein the processor is further configured to execute programmed instructions stored in the memory comprising:

receiving a search query from a user requesting one or more items of content;

searching the stored one or more items of categorizing information; and identifying an air broadcast radio frequency signal of the plurality of air broadcast radio frequency signals comprising the requested one or more items of content in response to the search query.

5. The radio communication device of claim 4 wherein the one or more items of content comprise broadcast content data, geographic data, one or more radio station identifiers, genre data, one or more keywords, or content rating data.

6. The radio communication device of claim 4 wherein the processor is further configured to execute programmed instructions stored in the memory comprising:

processing the identified air broadcast radio frequency signal comprising the requested one or more items of content to obtain the audio associated with the identified air broadcast radio frequency signal; and recording the obtained audio for the identified air broadcast radio frequency signal.

7. The radio communication device of claim 1 wherein the analyzing further comprises identifying one or more items of content indicating the occurrence of the event within a geographic area.

8. The radio communication device of claim 7 wherein the processor is further configured to execute programmed instructions stored in the memory comprising:

providing one or more registered users with a notification of the occurrence of the event.

9. The radio communication device of claim 8 further comprising a network interface in communication with the radio communication device, wherein the notification is provided by the network interface.

10. A method comprising:

simultaneously receiving, by a radio device, a plurality of air broadcast radio frequency signals within range of a transceiver of the radio device and identifying a subset of the plurality of air broadcast radio frequency signals having available content;

processing, by the radio device, one or more of the subset of the plurality of air broadcast radio frequency signals to obtain audio and auxiliary data associated with the one or more of the subset of the plurality of air broadcast radio frequency signals;

analyzing, by the radio device, the obtained audio and auxiliary data from the processed one or more of the subset of the plurality of air broadcast radio frequency signals to identify one or more items of content indicating the occurrence of an event;

categorizing, by the radio device, the one or more of the subset of the plurality of air broadcast radio frequency signals based on the analyzed audio and auxiliary data, wherein the categorizing further comprises identifying one or more items of categorizing information related to the event; and storing, by the radio device, the one or more items of categorizing information along with the analyzed audio and auxiliary data.

11. The method of claim 10 wherein analyzing the obtained audio further comprises performing a voice recognition analysis of the obtained audio.

12. The method of claim 10 wherein the identified one or more items of information related to the categorized radio frequency signals comprise a category of content, a source of the radio frequency signal, and a temporal identification of when the content is available.

13. The method of claim 10 further comprising:

receiving, by the radio device, a search query from a user requesting one or more items of content;

searching, by the radio device, the stored one or more items of categorizing information; and identifying, by the radio device, an air broadcast radio frequency signal of the plurality of air broadcast radio frequency signals comprising the requested one or more items of content in response to the search query.

14. The method of claim 13 wherein the one or more items of content comprise broadcast content data, geographic data, one or more radio station identifiers, genre data, one or more keywords, or content rating data.

15. The method of claim 13 further comprising:

processing, by the radio device, the identified air broadcast radio frequency signal comprising the requested one or more items of content to obtain the audio associated with the identified air broadcast radio frequency signal; and recording, by the radio device, the obtained audio for the identified air broadcast radio frequency signal.

16. The method of claim 10 wherein the analyzing further comprises identifying one or more items of content indicating the occurrence of the event within a geographic area.

17. The method of claim 16 further comprising:

providing, by the radio device, one or more registered users with a notification of the occurrence of the event.

18. The method of claim 17 wherein the event comprises an emergency situation and the one or more registered users comprises one or more emergency responders.

19. A non-transitory computer readable medium having stored thereon instructions for identifying content from one or more radio frequency signals comprising machine executable code which, when executed by a processor, causes the processor to perform steps comprising:

simultaneously receiving a plurality of air broadcast radio frequency signals within range of a transceiver of the radio device and identifying a subset of the plurality of air broadcast radio frequency signals having available content;

processing one or more of the subset of the plurality of air broadcast radio frequency signals to obtain audio and auxiliary data associated with the one or more of the subset of the plurality of air broadcast radio frequency signals;

analyzing the obtained audio and auxiliary data from the processed one or more of the subset of the plurality of air broadcast radio frequency signals to identify one or more items of content indicating the occurrence of an event;

categorizing the one or more of the subset of the plurality of air broadcast radio frequency signals based on the analyzed audio and auxiliary data, wherein the categorizing further comprises identifying one or more items of categorizing information related to the event; and storing the one or more items of categorizing information along with the analyzed audio and auxiliary data.

20. The medium of claim 19 wherein analyzing the obtained audio further comprises performing a voice recognition analysis of the obtained audio.

21. The medium of claim 19 wherein the identified one or more items of information related to the categorized radio frequency signals comprise a category of content, a source of the radio frequency signal, and a temporal identification of when the content is available.

22. The medium of claim 19 further comprising:

receiving a search query from a user requesting one or more items of content;

searching the stored one or more items of categorizing information; and identifying an air broadcast radio frequency signal of the plurality of air broadcast radio frequency signals comprising the requested one or more items of content in response to the search query.

23. The medium of claim 22 wherein the one or more items of content comprise broadcast content data, geographic data, one or more radio station identifiers, genre data, one or more keywords, or content rating data.

24. The medium of claim 22 further comprising:

processing the identified air broadcast radio frequency signal comprising the requested one or more items of content to obtain the audio associated with the identified air broadcast radio frequency signal; and recording the obtained audio for the identified air broadcast radio frequency signal.

25. The medium of claim 19 wherein the analyzing further comprises identifying one or more items of content indicating the occurrence of the event within a geographic area.

26. The medium of claim 19 further comprising:

providing one or more registered users with a notification of the occurrence of the event.

* * * * *